US009650774B2

(12) United States Patent
Zheng et al.

(10) Patent No.: US 9,650,774 B2
(45) Date of Patent: May 16, 2017

(54) DUAL CONTROL MODE-TYPE DEODORISING AND WATER DRAINAGE VALVE

(71) Applicant: XIAMEN HUIERJIE SANITARY WARE TECHNOLOGY CO., LTD., Fujian (CN)

(72) Inventors: Xiangji Zheng, Fujian (CN); Mingjin Chen, Fujian (CN); Hui Li, Fujian (CN)

(73) Assignee: Xiamen Huierjie Sanitary Ware Technology Co., Ltd., Xiamen (CN)

( * ) Notice: Subject to any disclaimer, the term of this patent is extended or adjusted under 35 U.S.C. 154(b) by 116 days.

(21) Appl. No.: 14/762,472

(22) PCT Filed: Jan. 16, 2014

(86) PCT No.: PCT/CN2014/070697
§ 371 (c)(1),
(2) Date: Jul. 22, 2015

(87) PCT Pub. No.: WO2014/114202
PCT Pub. Date: Jul. 31, 2014

(65) Prior Publication Data

US 2015/0361649 A1 Dec. 17, 2015

(30) Foreign Application Priority Data

Jan. 23, 2013 (CN) ..... 2013 2 0036383 U
Dec. 20, 2013 (CN) ..... 2013 2 0848276 U

(51) Int. Cl.
*E03D 9/052* (2006.01)
*E03D 1/30* (2006.01)
*E03D 1/34* (2006.01)

(52) U.S. Cl.
CPC ..... *E03D 9/052* (2013.01); *E03D 1/302* (2013.01); *E03D 1/34* (2013.01)

(58) Field of Classification Search
CPC ..... E03D 9/052; E03D 1/34; E03D 1/302
USPC ..... 4/347
See application file for complete search history.

(56) References Cited

U.S. PATENT DOCUMENTS 3,605,126 A * 9/1971 Henry ..... E03D 9/05 4/347
4,031,574 A * 6/1977 Werner ..... E03D 9/052 4/347
6,694,534 B2 * 2/2004 Stone ..... E03D 9/052 4/347

* cited by examiner

*Primary Examiner* — Tuan N Nguyen

(57) ABSTRACT

The invention relates to an improved dual control mode-type deodorising and water drainage valve. The water drainage valve includes a linear control water drainage mechanism and a hydraulic water drainage mechanism controlled by a micro-immersible pump. The linear control water drainage mechanism includes a piston with the piston being partitioned into an upper and lower chamber by a central partition plate; the upper chamber is a piston control chamber for controlling the resetting of the piston, and the linear control water drainage mechanism controls the upward action of the piston; and the lower chamber is a water drainage fluid chamber for creating water pressure on the piston. More than one through hole is provided in the central partition plate to communicate with the upper and lower chambers partitioned by the central partition plate.

13 Claims, 9 Drawing Sheets

DUAL CONTROL MODE-TYPE DEODORISING AND WATER DRAINAGE VALVE

BACKGROUND OF THE INVENTION

1. Field of the Invention

The invention relates to sanitary fixtures and more particularly to a flush valve adapted to activate to remove toilet odor by activating one of a linear control water drainage mechanism and a hydraulic water drainage mechanism.

2. Description of Related Art

People may press a push button of a toilet to dispose feces after discharging the body wastes from the rectum. But odor may linger in the bathroom and people may feel uncomfortable. There are many patent disclosures for removing odor from toilet. For example, Chinese Patent Numbers ZL00263940.8, ZL92245259, ZL200520016073.6, ZL200720131343.7, and ZL200520000309.7 each disclose a device for removing odor out of toilet after discharging feces. However, these patents are disadvantageous due to complicated mechanisms, bulkiness, customization of ceramic toilet bowl, modification of adjacent bathroom wall, huge work, poor quality, and impracticability.

Chinese Patent No. ZL201110001526.8 discloses a device adapted to mount in a toilet for odor removal. The device comprises an odor exhaust unit, a flush system, an overflow assembly, and a water inlet system. The patent has advantages of excellent odor removal, adaptability, and being configured to modify. But the patent also has following disadvantages because it adopts tap water and pressure as means for flushing: Flush valve and inlet valve are co-activated by a hydraulic switch. An inlet filter can be partially or completely blocked after one to two years of use if quality of tap water is not good. It can greatly decrease water pressure. And in turn, the flush capability of the toilet can be compromised due to low water pressure. The amount of water per flushing is subject to water pressure because the flush valve is activated by tap water. This is disadvantageous to water saving toilets. Water stored in the toilet tank cannot be used to for flushing if the supply of tap water is cut off. This is because there is no activation of the device. Finally, there are excessive components which are difficult of being correctly installed.

Notwithstanding the prior art, the invention is neither taught nor rendered obvious thereby.

SUMMARY OF THE INVENTION

It is therefore one object of the invention to provide a flush valve adapted to activate to remove toilet odor by activating one of two mechanisms in order to eliminate drawbacks associated with the prior art. The flush valve has the advantages of simple components, superior adaptability, high efficiency, and eliminating odor after discharging feces.

For achieving above and other objects, in an aspect of the invention there is an odor removal system for removing odor from a toilet, comprising a flush valve disposed in a toilet tank, the flush valve including a valve base; a linear control water drainage mechanism disposed above the valve base; and a hydraulic water drainage mechanism disposed above the valve base; characterized by the linear control water drainage mechanism includes a piston and a central partition plate for forming a piston chamber in an upper portion of the piston, the piston chamber configured to accommodate reciprocation of the piston, and a water drainage fluid chamber for flushing in a lower portion of the piston, the water drainage fluid chamber for flushing configured to apply water pressure to the piston; and the hydraulic water drainage mechanism includes a micro-immersible pump including an inlet communicating with a reservoir which communicates with the toilet tank through a filter, and an outlet communicating with the water drainage fluid chamber for flushing.

Preferably, the central partition plate includes a plurality of through holes for communicating the piston chamber with the water drainage fluid chamber for flushing, and wherein a sum of areas of cross sections of the through holes is not greater than 15 $mm^2$.

Preferably, there is further provided a biasing member in the piston chamber biasing against the central partition plate, and a rope having a first end connected to the piston.

Preferably, there is further provided a venting pipe extending from the valve base, and a waterproof spiral staircase disposed in the venting pipe, the spiral staircase including a plurality of step members equally spaced along an axis thereof.

Preferably, there is further provided an odor removal device communicating with the valve base via a venting pipe, the odor removal device including a fan coaxial with the venting pipe and communicating therewith, an outlet member, and an odor removal medium.

Preferably, the odor removal medium is a high pressure ozone ceramic member controlled by an ozone generation control circuit.

Preferably, the odor removal medium is a mesh plate coated with catalyst, the mesh plate disposed in the outlet member.

By utilizing the invention, the follow advantages are obtained: The flush valve is adapted to activate to remove toilet odor by activating one of the linear control water drainage mechanism and the hydraulic water drainage mechanism. It is understood that odor may exist in the lower chamber between flushing and an immediate next water refill and the remaining odor is adverse to provide a precise amount of water for flushing. The provision of the through holes in the central partition plate allows odor in the water drainage fluid chamber for flushing flowing to the piston chamber. As such, the water drainage fluid chamber for flushing is a vacuum, thereby precisely providing the desired amount of water for flushing. Variation of the amount of water for flushing is decreased to a minimum. A constant amount of water for flushing can be carried out with adverse factors of the environment being substantially eliminated. It is highly reliable. Its useful life is prolonged. The waterproof spiral staircase provided in the venting pipe can prevent water from drawing into the odor removal device when flushing. Otherwise, the odor removal device may malfunction. The odor removal medium in the odor removal device can effectively remove noxious vapors from the toilet.

The above and other objects, features and advantages of the invention will become apparent from the following detailed description taken with the accompanying drawings.

DETAILED DESCRIPTION OF THE INVENTION

Figure 1:
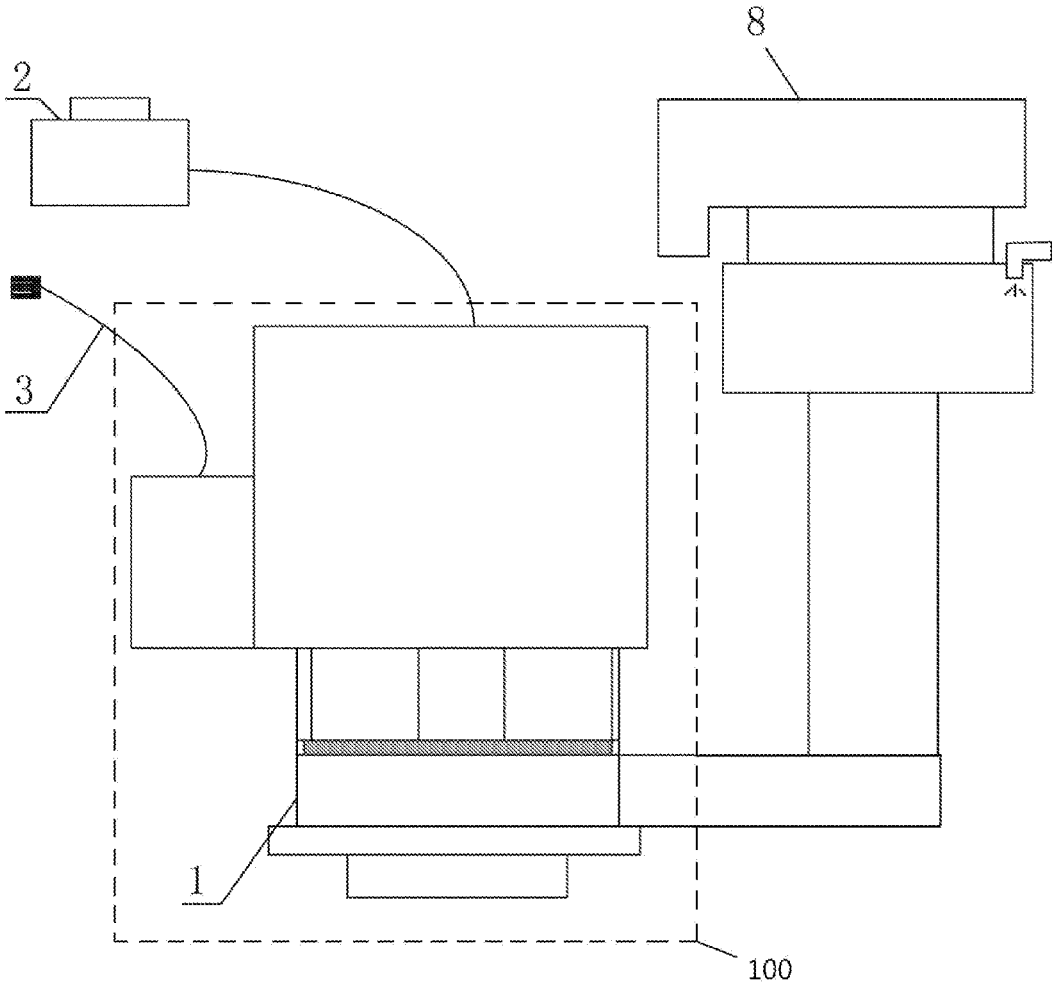
FIG. 1 is a schematic of a flush valve according to the invention.

Referring to FIGS. 1 to 8, a flush valve 1 for removing toilet odor in accordance with the invention is disposed in a toilet tank 100. The flush valve 1 includes a valve base 10. There are further provided a linear control water drainage mechanism 2 and a hydraulic water drainage mechanism 3. The valve base 10 is in communication with a toilet. Both the linear control water drainage mechanism 2 and the hydraulic water drainage mechanism 3 are disposed above the valve base 10.

Figure 2:
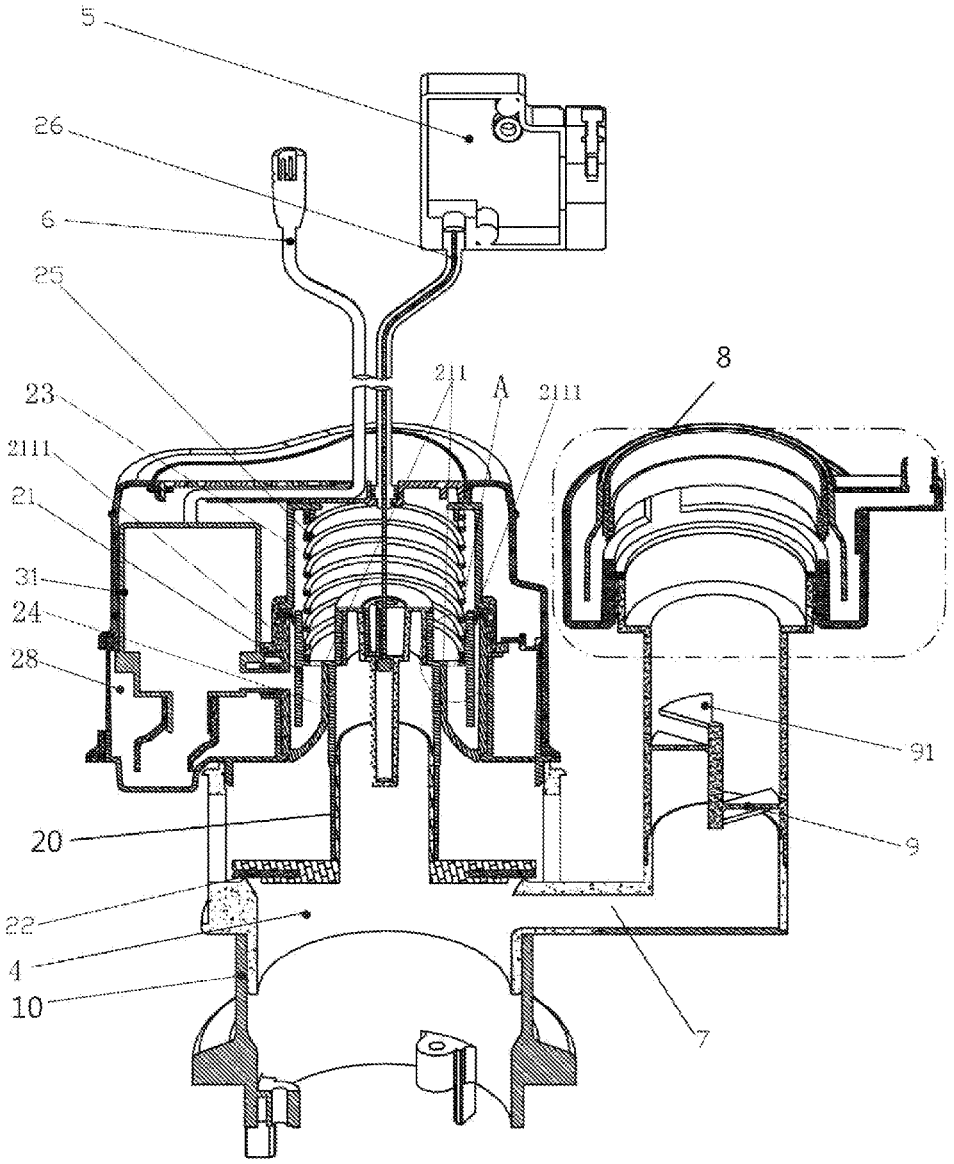
FIG. 2 is a longitudinal sectional view of the flush valve and some associated components.
Figure 3A:
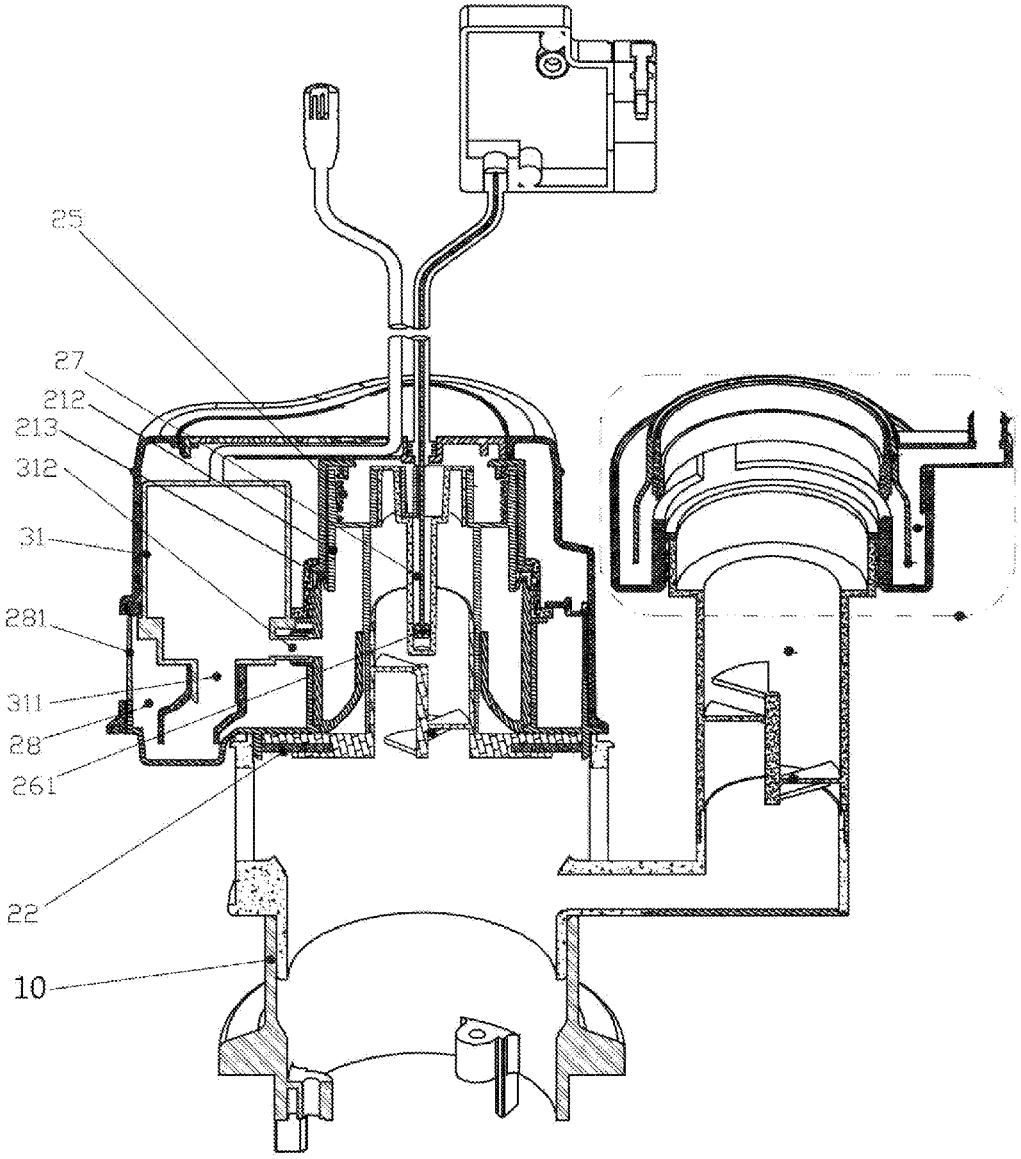
FIG. 3A is a view similar to FIG. 2 showing activation of the hydraulic water drainage mechanism for flushing.
Figure 8:
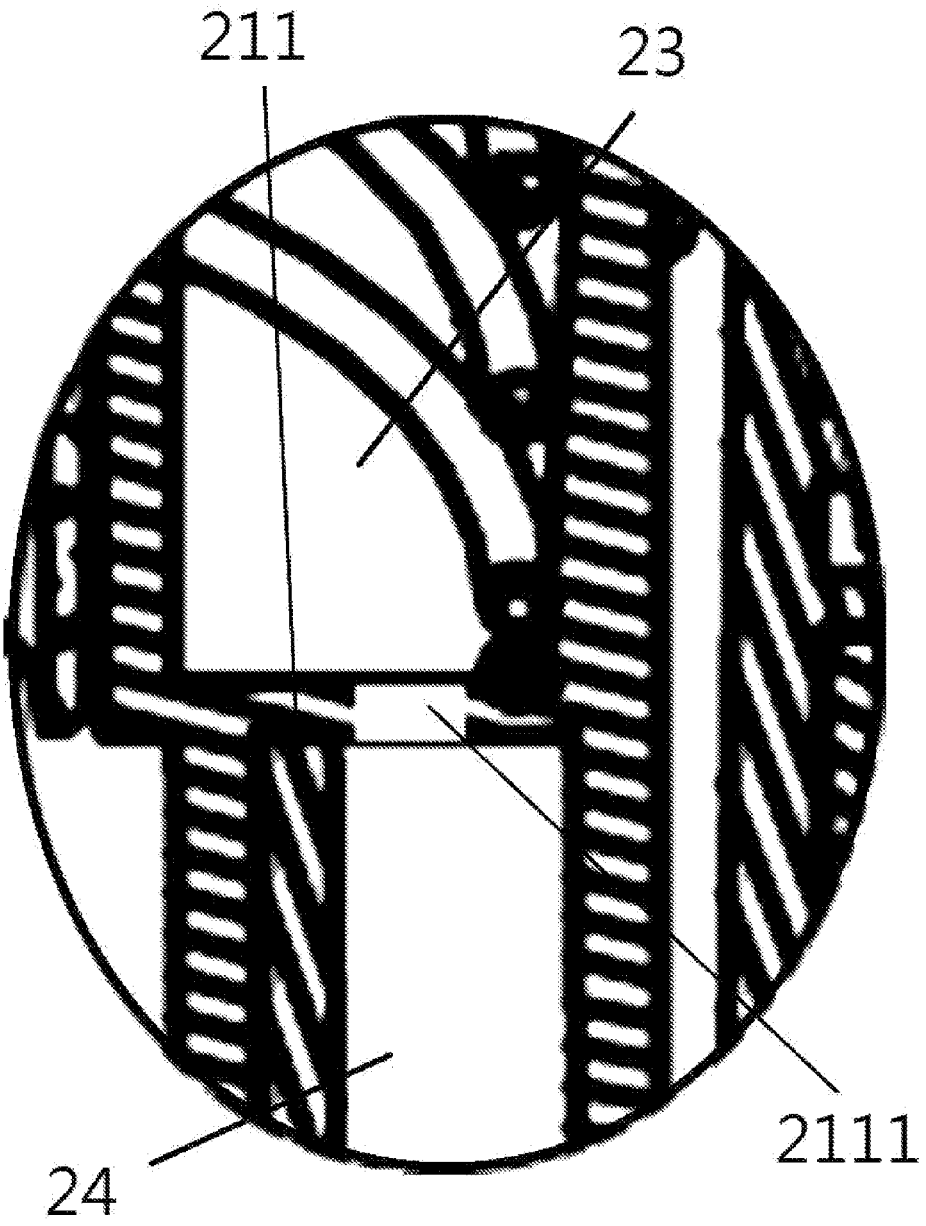
FIG. 8 is a detailed view of the area in circle A of FIG. 2.

As shown in FIGS. 2 and 3A, the linear control water drainage mechanism 2 includes a hollow body 20, a piston 21 slidably disposed in the body 20, and a sealing rubber 22 under the piston 21 for sealing the valve base 10. A central partition plate 211 in the piston 21 separates space in the piston 21 into upper and lower chambers. As shown in FIG. 8, at least one through hole 2111 is provided in the central partition plate 211 for communicating the upper chamber with the lower chamber or vise versa. The number, shape, and location of the through hole 2111 is not limited as long as it is provided in the central partition plate 211. Preferably, the sum of areas of cross sections of all through holes 2111 is not greater than 15 $mm^2$. The provision of the through holes 2111 is to communicate the upper chamber with the lower chamber or vise versa so that the following advantages can be achieved: Odor can be completely expelled out of the lower chamber between flushing and an immediate next water refill. A precise amount of water for flushing can be controlled. A stable water supply for flushing can be achieved. Variation of the amount of water for flushing is decreased to a minimum. Adverse effect of external factors is decreased to a minimum. The purpose of controlling the sum of areas of cross sections of all through holes 2111 is to keep water pressure in the lower chamber at an optimum range.

A piston chamber 23 is provided in the upper chamber for accommodating the reciprocation of the piston 21. A water drainage fluid chamber 24 for flushing is provided in the lower chamber for exerting water pressure to the piston 21. As show in FIG. 8, the water drainage fluid chamber 24 for flushing communicates with the piston chamber 23 via the through hole 2111. Thus, the provision of at least one through hole 2111 is required. Odor may exist in the lower chamber between flushing and an immediate next water refill and the odor is adverse to provide a precise amount of water for flushing if there is no through hole through the central partition plate 211. That is, variation of the amount of water for flushing is great. The provision of the through holes 2111 allows the odor in the water drainage fluid chamber 24 for flushing flowing to the piston chamber 23 via the through holes 2111. As such, the water drainage fluid chamber 24 for flushing is a vacuum, thereby precisely providing the desired amount of water for flushing. Variation of the amount of water for flushing is decreased to a minimum. A constant amount of water for flushing can be carried out with adverse factors of the environment being substantially eliminated.

In the piston chamber 23, there are provided a torsion spring 25 biasing against the central partition plate 211. The torsion spring 25 can push the piston 21 to move downward when the water pressure does not exist or any external pushing and pulling force is removed. Thus, the sealing rubber 22 under the piston 21 can seal an outlet 4 on top of the valve base 10. As a result, a single flushing is finished.

The linear control water drainage mechanism 2 includes a rope (e.g., steel rope) 26 having one end connected to a controller 5 and the other end connected to a metal block 261 in a chamber member 27 which is disposed above the central partition plate 211. An annular sliding member 212 disposed externally of the central partition plate 211 is slidably mounted onto an inner surface of the body 20. A piston rubber 213 is provided on a lower portion of an outer surface of the sliding member 212 for sealing the water drainage fluid chamber 24 for flushing. Thus, the piston 21 can move upward in response to water pressure applied thereto.

Figure 3B:
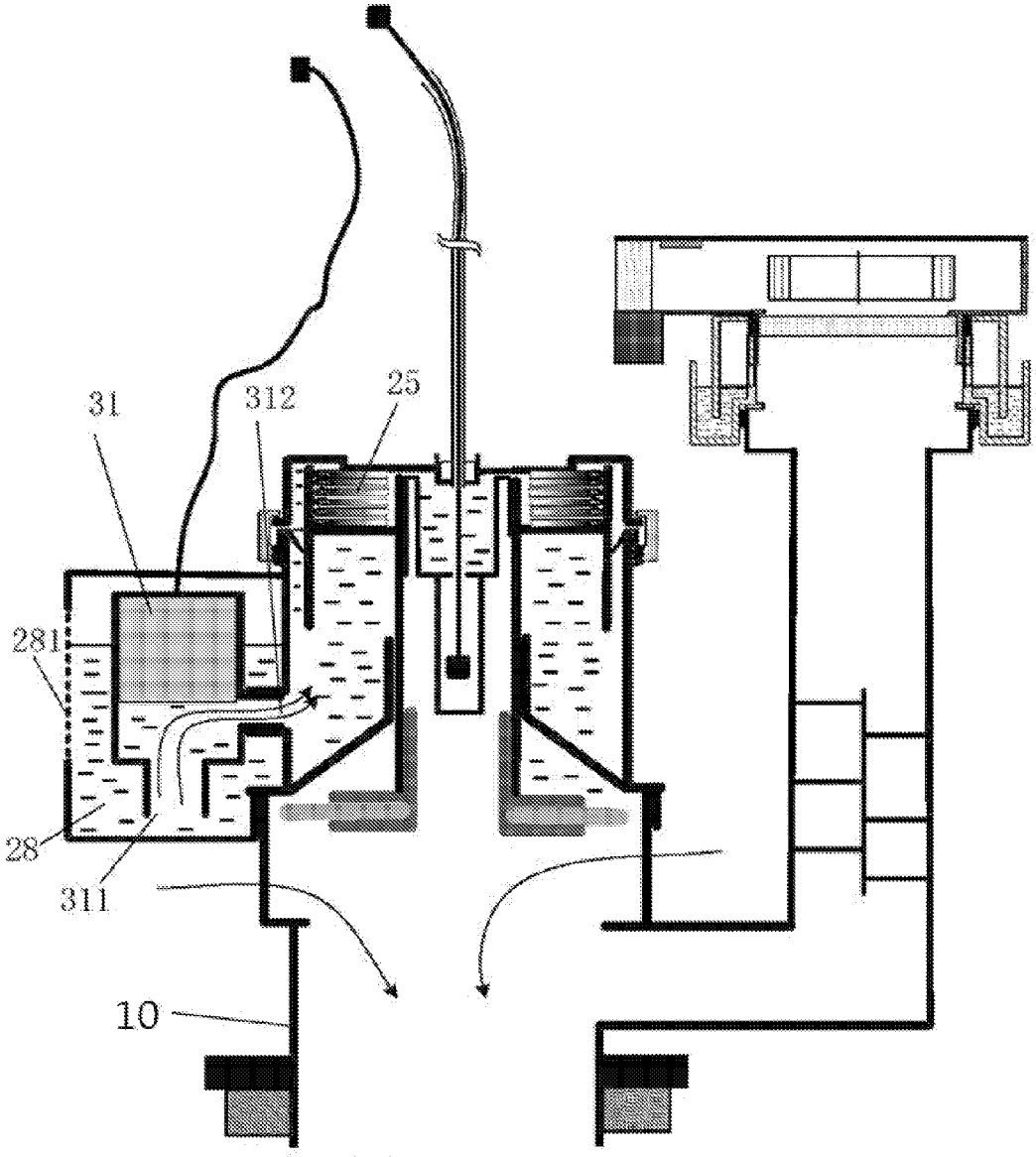
FIG. 3B is a schematic of FIG. 3A.

As shown in FIGS. 2, 3A and 3B, the hydraulic water drainage mechanism 3 includes a micro-immersible pump 31 activated by a sunken pump controller 6, the micro-immersible pump 31 having an inlet 311 in communication with a reservoir 28 having a filter 281. The reservoir 28 communicates with the toilet tank 100 through the filter 281 to ensure water stored in the reservoir 28 is filtered. Otherwise, impurities in the water may accumulate to cause the micro-immersible pump 31 to malfunction. An outlet 312 of the micro-immersible pump 31 communicates with the water drainage fluid chamber 24 for flushing.

Figure 4:
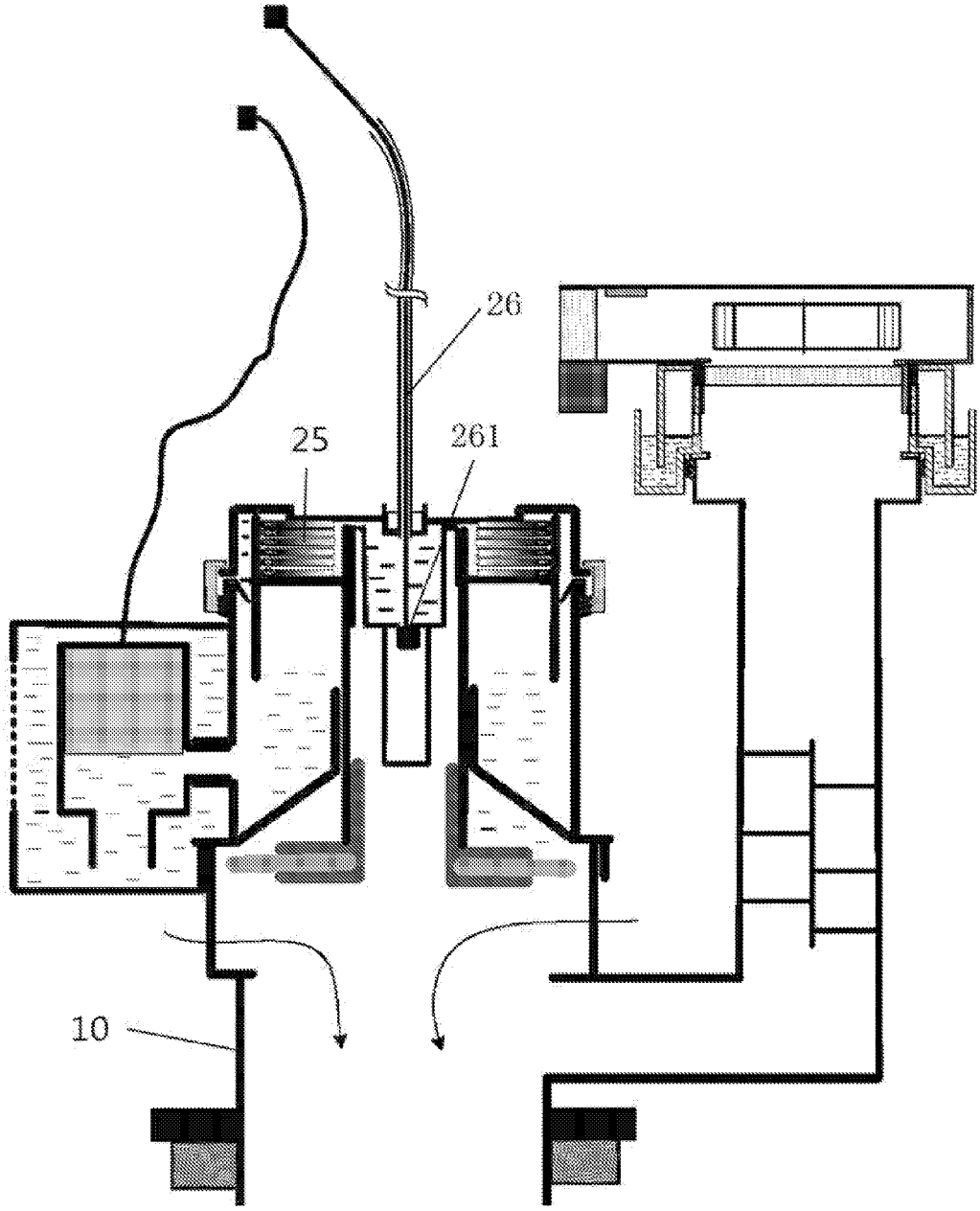
FIG. 4 is a view similar to FIG. 3B showing activation of the hydraulic water drainage mechanism for flushing.

As shown in FIG. 2, in a closed state of the body 20, the outlet 4 above the valve base 10 is sealed by the sealing rubber 22 under the piston 21. As shown in FIG. 4, after discharging feces, a person may pull the rope 26 to lift the metal block 261 and thus the piston 21. And in turn, the piston 21 moves upward with the torsion spring 25 compressed. As such, the water in the reservoir 28 flows out of the outlet 4 to flush the feces in the toilet.

Alternatively, as shown in FIGS. 3A and 3B, the person may activate the micro-immersible pump 31 to draw water in the reservoir 28 into the water drainage fluid chamber 24 for flushing through the outlet 312 of the micro-immersible pump 31. Water pressure is built immediately in the water drainage fluid chamber 24 for flushing to lift the piston 21 with the torsion spring 25 compressed. As such, the water in the reservoir 28 flows out of the outlet 4 to flush the feces in the toilet.

Figure 5:
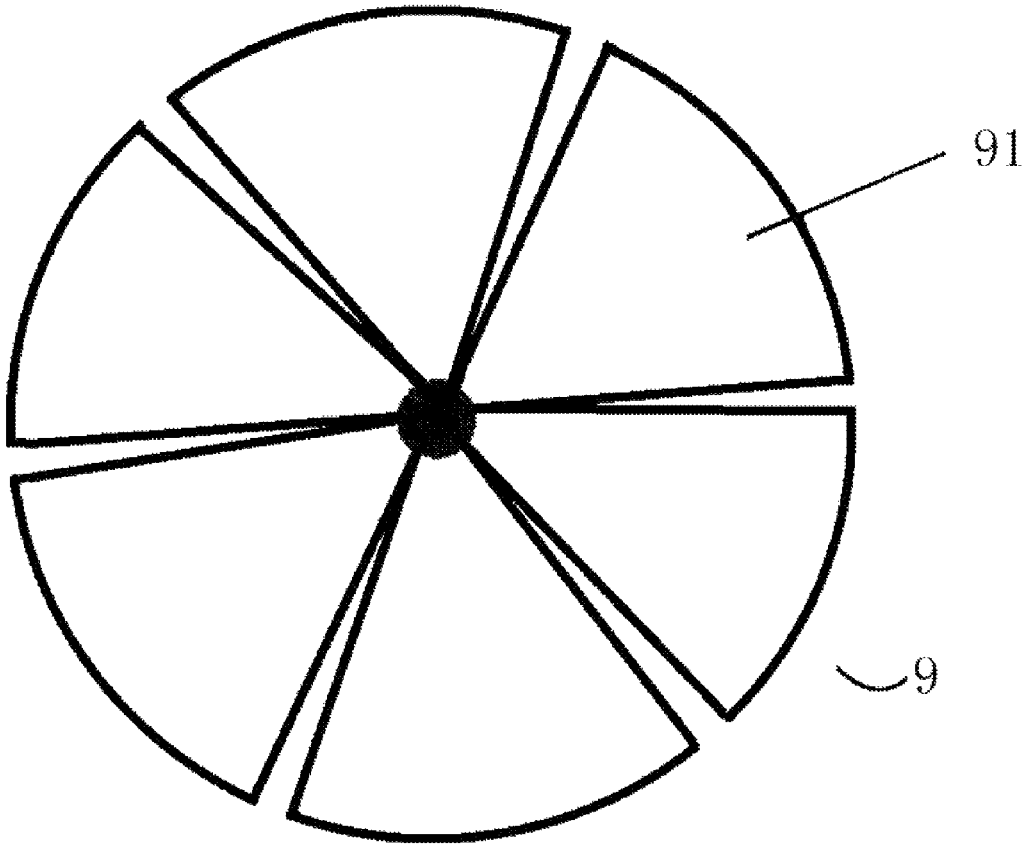
FIG. 5 is a top view of the waterproof spiral staircase of FIG. 3A.
Figure 7:
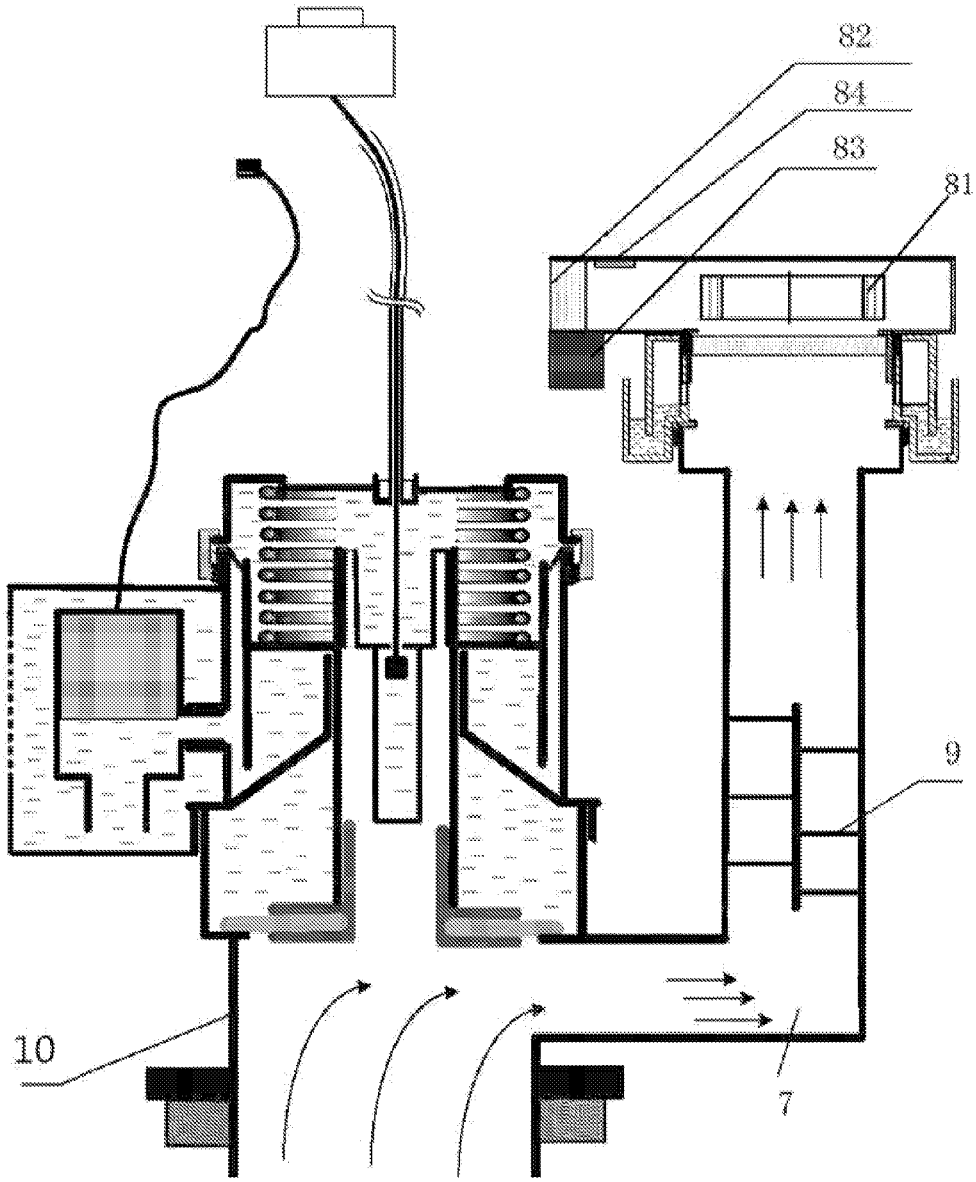
FIG. 7 is a view similar to FIG. 4 showing activation of the odor removal device after discharging feces.

As shown in FIGS. 1 and 7, a venting pipe 7 communicates the outlet 4 with an odor removal device 8. A waterproof spiral staircase 9 is provided in the venting pipe 7 for preventing water from drawing into the odor removal device 8 when flushing. As shown in FIGS. 2 and 5, the waterproof spiral staircase 9 includes a plurality of wedge shaped step members 91 equally spaced along an axis thereof.

Figure 6:
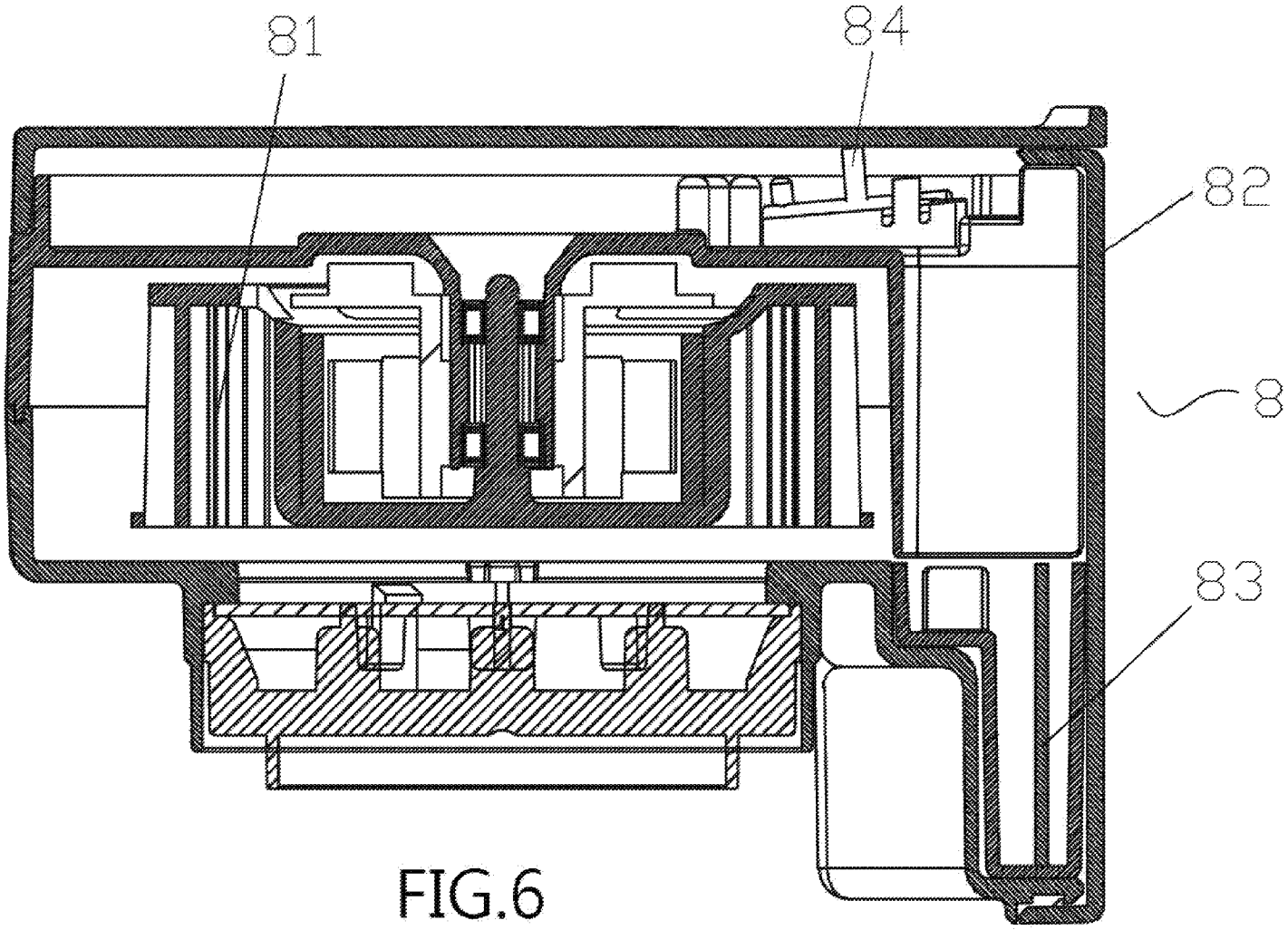
FIG. 6 is a longitudinal sectional view of the odor removal device.

As shown in FIGS. 6 and 7, the odor removal device 8 includes an odor removal medium (not shown), a fan 81 coaxial with the venting pipe 7 and communicating therewith, an outlet 82 in a housing, a mesh plate (not shown) coated with catalyst $TiO^2$ is provided in the outlet 82. The mesh plate is made of ceramic, aluminum, or metal. The odor removal medium is implemented as a high pressure ozone ceramic member 84 controlled by an ozone generation control circuit 83. The high pressure ozone ceramic member 84 is provided on an underside of a top of the odor removal device 8 adjacent to the outlet 82. After discharging feces, flushing, and activating the fan 81, odor is drawn into the fan 81 via the venting pipe 7. The odor reacts with ozone generated by the high pressure ozone ceramic member 84 or the catalyst of the mesh plate in the outlet 82 to convert into a substance without unpleasant property.

While the invention has been described in terms of preferred embodiments, those skilled in the art will recognize that the invention can be practiced with modifications within the spirit and scope of the appended claims.

What is claimed is:

1. An odor removal system for removing odor from a toilet, comprising:

a flush valve disposed in a toilet tank, the flush valve including a valve base;

a linear control water drainage mechanism disposed above the valve base; and a hydraulic water drainage mechanism disposed above the valve base;

characterized by the linear control water drainage mechanism includes a piston and a central partition plate for forming a piston chamber in an upper portion of the piston, the piston chamber configured to accommodate reciprocation of the piston, and a water drainage fluid chamber for flushing in a lower portion of the piston, the water drainage fluid chamber for flushing configured to apply water pressure to the piston; and the hydraulic water drainage mechanism includes a micro-immersible pump including an inlet communicating with a reservoir which communicates with the toilet tank through a filter, and an outlet communicating with the water drainage fluid chamber for flushing.

2. The odor removal system of claim 1, characterized by the central partition plate includes a plurality of through holes for communicating the piston chamber with the water drainage fluid chamber for flushing, and a sum of areas of cross sections of the through holes is not greater than $15mm^2$.

3. The odor removal system of claim 1, characterized by further comprises a biasing member in the piston chamber biasing against the central partition plate, and a rope having a first end connected to the piston.

4. The odor removal system of claim 3, characterized by further comprises a venting pipe extending from the valve base, and a waterproof spiral staircase disposed in the venting pipe, the spiral staircase including a plurality of steps equally spaced along an axis thereof.

5. The odor removal system of claim 4, characterized by further comprises an odor removal device communicating with the valve base via a venting pipe, the odor removal device including a fan coaxial with the venting pipe and communicating therewith, an outlet member, and an odor removal medium.

6. The odor removal system of claim 5, characterized by the odor removal medium is a mesh plate coated with catalyst, the mesh plate disposed in the outlet member.

7. The odor removal system of claim 3, characterized by further comprises an odor removal device communicating with the valve base via a venting pipe, the odor removal device including a fan coaxial with the venting pipe and communicating therewith, an outlet member, and an odor removal medium.

8. The odor removal system of claim 7, characterized by the odor removal medium is a high pressure ozone ceramic member controlled by an ozone generation control circuit.

9. The odor removal system of claim 1, characterized by further comprises a venting pipe extending from the valve base, and a waterproof spiral staircase disposed in the venting pipe, the spiral staircase including a plurality of steps equally spaced along an axis thereof.

10. The odor removal system of claim 9, characterized by further comprises an odor removal device communicating with the valve base via a venting pipe, the odor removal device including a fan coaxial with the venting pipe and communicating therewith, an outlet member, and an odor removal medium.

11. The odor removal system of claim 10, characterized by the odor removal medium is a mesh plate coated with catalyst, the mesh plate disposed in the outlet member.

12. The odor removal system of claim 1, characterized by further comprises an odor removal device communicating with the valve base via a venting pipe, the odor removal device including a fan coaxial with the venting pipe and communicating therewith, an outlet member, and an odor removal medium.

13. The odor removal system of claim 12, characterized by the odor removal medium is a high pressure ozone ceramic member controlled by an ozone generation control circuit.

* * * * *